US005711479A

United States Patent [19]

Spronk

[11] Patent Number: 5,711,479

[45] Date of Patent: Jan. 27, 1998

[54] BOXLIKE PACKAGE WITH CLOSABLE DISPENSING OPENING

[75] Inventor: Johannes Fredericus Spronk, Lelystad-Haven, Netherlands

[73] Assignee: Crystal B.V., Almere, Netherlands

[21] Appl. No.: 695,704

[22] Filed: Jul. 2, 1996

Related U.S. Application Data

[63] Continuation of Ser. No. 538,625, Oct. 4, 1995, abandoned.

[30] Foreign Application Priority Data

Oct. 4, 1994 [NL] Netherlands ..... 9401637

[51] Int. Cl.[6] ..... B65D 5/74

[52] U.S. Cl. ..... 229/218; 279/121; 279/217

[58] Field of Search ..... 229/121, 215, 229/217, 218, 229

[56] References Cited

U.S. PATENT DOCUMENTS

| | | | |
|---|---|---|---|
| 1,092,148 | 4/1914 | Jones | 229/218 |
| 1,203,924 | 11/1916 | Snyder | 229/218 |
| 2,313,987 | 3/1943 | Buttery | 229/218 |
| 2,390,392 | 12/1945 | Rous . | |
| 2,417,498 | 3/1947 | Hultin | 229/218 |
| 2,565,182 | 8/1951 | Maxon | 229/218 |
| 2,811,297 | 10/1957 | Maxon | 229/218 |
| 2,983,421 | 5/1961 | Turpin | 229/121 |
| 2,983,424 | 5/1961 | Glass | 229/121 |
| 2,997,221 | 8/1961 | Gimple . | |
| 3,954,220 | 5/1976 | Foster | 229/121 |
| 4,180,167 | 12/1979 | Leavitt et al. | 229/218 |
| 5,082,117 | 1/1992 | Zimmermann | 229/218 |

FOREIGN PATENT DOCUMENTS

| | | | |
|---|---|---|---|
| 835 957 | 1/1939 | France . | |
| 1 248 546 | 11/1960 | France . | |
| 342137 | 1/1931 | United Kingdom | 229/218 |
| 615161 | 1/1949 | United Kingdom | 229/218 |

*Primary Examiner*—Gary E. Elkins
*Attorney, Agent, or Firm*—Kinney & Lange, P.A.

[57] ABSTRACT

The invention relates to a boxlike package to be produced by folding and adhesion, which package comprises a dispensing opening provision (8) which is provided at the location of a corner point (7) of the package. The dispensing opening provision (8) is dust-tightly reclosable and is so designed that no wall portions or like obstacles are situated in the dispensing path. The dispensing opening provision comprises an anti push-through panel (14) with anti push-through portions (14*a*) which prevent the parts (9, 12) which close off the dispensing opening from being pushed into the box interior during the reclosure of the dispensing opening provision (8). The boxlike package may further comprise a look edge (15) which prevents the dispensing opening from being opened unintentionally by shaking or shocks.

20 Claims, 5 Drawing Sheets

BOXLIKE PACKAGE WITH CLOSABLE DISPENSING OPENING

This is a continuation of application Ser. No. 08/538,625, filed Oct. 4, 1995 now abandoned.

BACKGROUND OF THE INVENTION

This invention relates to a boxlike package which is produced from a single blank through folding and adhesion, wherein a first and a second side panel adjoin each other through a side corner, wherein the side panels each adjoin a top wall by a first and a second upper edge, respectively, and wherein the upper edges and the side corner edge intersect in a corner point.

In general, the known boxlike packages comprise dispensing openings which are provided in a sidewall or on a corner edge. A boxlike package that would have a reclosable dispensing opening provision at the location of a corner point where three walls of the package, in particular two sidewalls and a top wall, meet, would have a major advantage in that the sprinkling material or the liquid contained in the package, when being dispensed through the dispensing opening, is not-hindered by wall portions or like obstacles that partly block the dispensing path.

In addition, it is of importance for a dispensing opening provision to be reclosable in substantially dust-tight and air-tight manner, so that after the dispensing opening provision has been opened the contents of the boxlike package do not remain in contact with the outside air, which would considerably reduce the storage life of the packaged product. During the reclosure of the dispensing opening provision, the closing parts thereof should be prevented from being pressed into the box interior, as a result of which it would no longer be possible to open the box inasmuch as the closing parts of the dispensing opening can no longer be gripped by the user.

A drawback of the known dispensing opening provisions is that, if they are reclosable at all, they do not ensure a proper seal of the dispensing opening in the reclosed position, so that the contents of the package are still in contact with the outside air, while moreover there is a significant chance of the dispensing opening being opened unintentionally by impact or shocks.

The object of the invention is to provide a boxlike package with a dispensing opening provision that has the above-described advantages but does not have the above-mentioned drawbacks.

SUMMARY OF THE INVENTION

The present invention provides a boxlike package which is produced from a single blank through folding and adhesion, in which a first and second side pane adjoin each other through a side corner edge, which side panels each adjoin a top wall by a first and a second upper edge respectively, said upper edges and the side corner edge intersecting in a corner point. A reclosable dispensing opening provision is provided at the location of the corner point. The dispensing opening provision includes two spout surfaces which comprise a first and a second, and a third and a fourth segment. In the unopened condition of the dispensing opening provision, the first and the second segment form part of the top wall and are connected therewith via perforation, tear and/or cutting lines, while the third and the fourth segment are situated on the side of the top wall proximal to the box interior. For forming a dispensing opening in the top wall, the perforation, tear and/or cutting lines are breakable, so that the first and the second segment can be swung clear of the top wall. In an opened condition of the dispensing opening provision, the first and the second segment are situated in a plane which also contains the first side panel, while the third and the fourth segment are situated in the plane which contains the second side panel. In a reclosed condition of the dispensing opening provision, the first and the fourth segment are situated in a plane which also contains said top wall, while the second and the third segment are in abutment. An anti trash-through panel is arranged against the side of the top wall proximal to the box interior. The anti push-through panel partly reduces the dispensing opening through anti push-through portions, so that the first and the fourth segment cannot be pushed into the box interior during the reclosure of the dispensing opening.

A so designed dispensing opening provision, arranged in a corner point, has the advantage that it is substantially dust-tightly and air-tightly reclosable without the risk that the closing parts of the dispensing opening, that is, the first and the fourth segment, are pressed into the box interior and cannot be retrieved therefrom for the purpose of re-opening the dispensing opening provision. By virtue of the spout surfaces being disposed in the same plane as the side panels of the boxlike package, the material to be dispensed or poured experiences no hindrance from wall portions partly blocking the dispensing path. Because the boxlike package is manufactured from a one-piece blank and because the dispensing opening to be formed is located in a corner of the package, the package can be filled to the very top and the amount of cardboard required for manufacturing a package of a particular volume can be minimized.

BRIEF DESCRIPTION OF THE DRAWINGS

Further elaborations of the invention are described in the subclaims and will be further clarified hereinafter on the basis of some exemplary embodiments, with reference to the drawings. In the drawings:

DETAILED DESCRIPTION OF THE PREFERRED EMBODIMENTS

Figure 1:
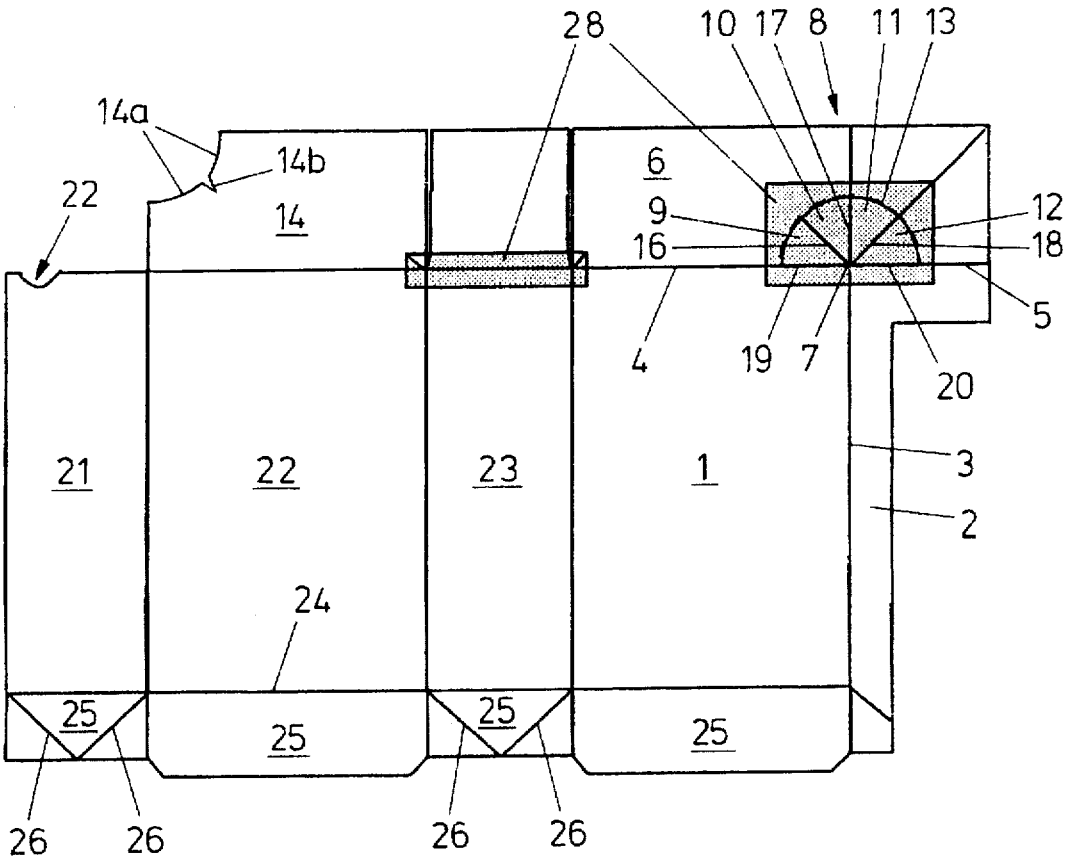
FIG. 1 shows a blank of the boxlike package shown in FIGS. 2–4.

All exemplary embodiments shown relate to a boxlike package which is composed from a single blank by folding and adhesion.

The package comprises at least a first 1 and a second 2 side panel, which adjoin each other through a side corner edge 3. The side panels 1, 2 each adjoin a top wall 6 by a first 4 and a second 5 upper edge. The upper edges 4, 5 and the side corner edge 3 intersect in a corner point 7. Provided at the location of the corner point 7 is a reclosable dispensing opening provision 8, which comprises two spout surfaces 9, 10 and 11, 12, respectively, which comprise a first 9 and a second 10, and a third 11 and a fourth 12 segment, respectively. In the unopened condition of the box, the first and the second segment 9, 10 form part of the upper wall 6 and are connected therewith via perforation, tear and/or cutting lines 13, while the third and the fourth segment 11, 12 are situated on the side of the top wall 6 proximal to the box interior. For forming a dispensing opening in the top wall 6, the perforation, tear and/or cutting lines 13 are breakable, so that the first and the second segment 9, 10 can be swung clear of the top wall 6. In an open condition of the dispensing opening provision 8, the first and the second segment 9, 10 are situated in a plane which also contains the first side panel 1. The third and the fourth segment 11, 12 are situated in the plane which also contains the second side panel 2. In the reclosed condition of the dispensing opening provision 8, the first and the fourth segment 9, 12 are situated in a plane which also contains the above-mentioned top wall 6, while the second and the third segment 10, 11 are in surface-to-surface abutment. Arranged against the side of the top wall 6 proximal to the box interior is an anti push-through panel 14, which partly reduces the dispensing opening through anti push-through portions 14*a*, so that the first and the fourth segment 9, 12 cannot be pushed into the box interior during the reclosure of the dispensing opening.

Figure 2:
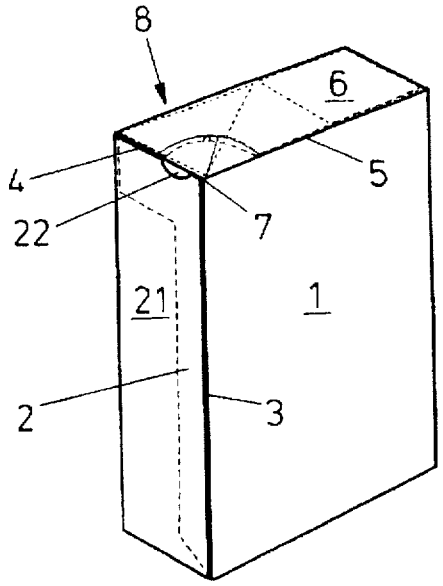
FIG. 2 shows the boxlike package, of which the blank is shown in FIG. 1, in unopened condition.
Figure 3:
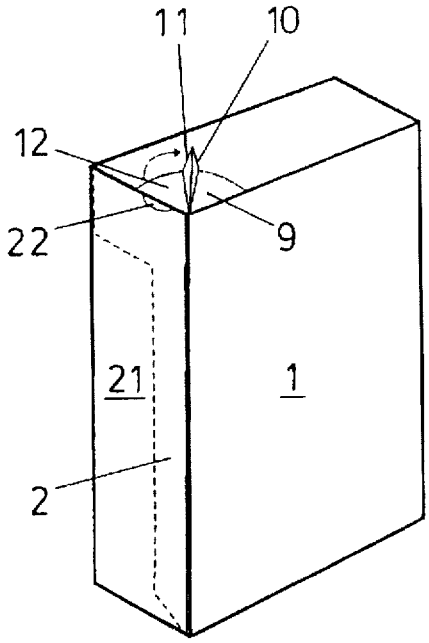
FIG. 3 shows the package of FIG. 2 in half-open condition.
Figure 4:
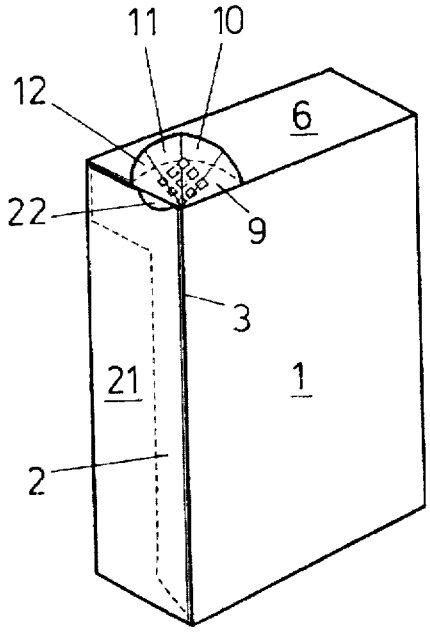
FIG. 4 shows the package of FIG. 2 in opened condition.

The unopened condition of the dispensing opening provision is shown in FIG. 2. A half-open condition is shown in FIG. 3, while the fully opened condition of the dispensing opening provision 8 is shown in FIG. 4.

The anti push-through portions 14*a*, which are clearly visible in FIG. 1, are so designed that the second and the third segment 10, 11, when situated in the box interior in the reclosed condition of the dispensing opening provision 8, are in frictional engagement therewith. In the exemplary embodiment shown, this has been effected in that the anti push-through panel 14 comprises a recess in the form of a quarter circle of which the radius is a fraction smaller than that of the quarter circle-shaped dispensing opening which can be formed in the top wall 6 by breaking the perforation line 13 when opening the dispensing opening provision 8. The quarter circle-shaped recess in the anti push-through panel 14 comprises halfway the circular arc thereof a notch 14*b* through which the abutting second and third segments 10, 11 can be moved during the reclosure of the opening in order to accommodate them in the box interior. In the reclosed position, the second and the third segment 10, 11 are in frictional engagement with the notch 14*b*. As a result, in the reclosed condition the dispensing opening provision remains properly closed and cannot spring open in uncontrolled manner.

Figure 9:
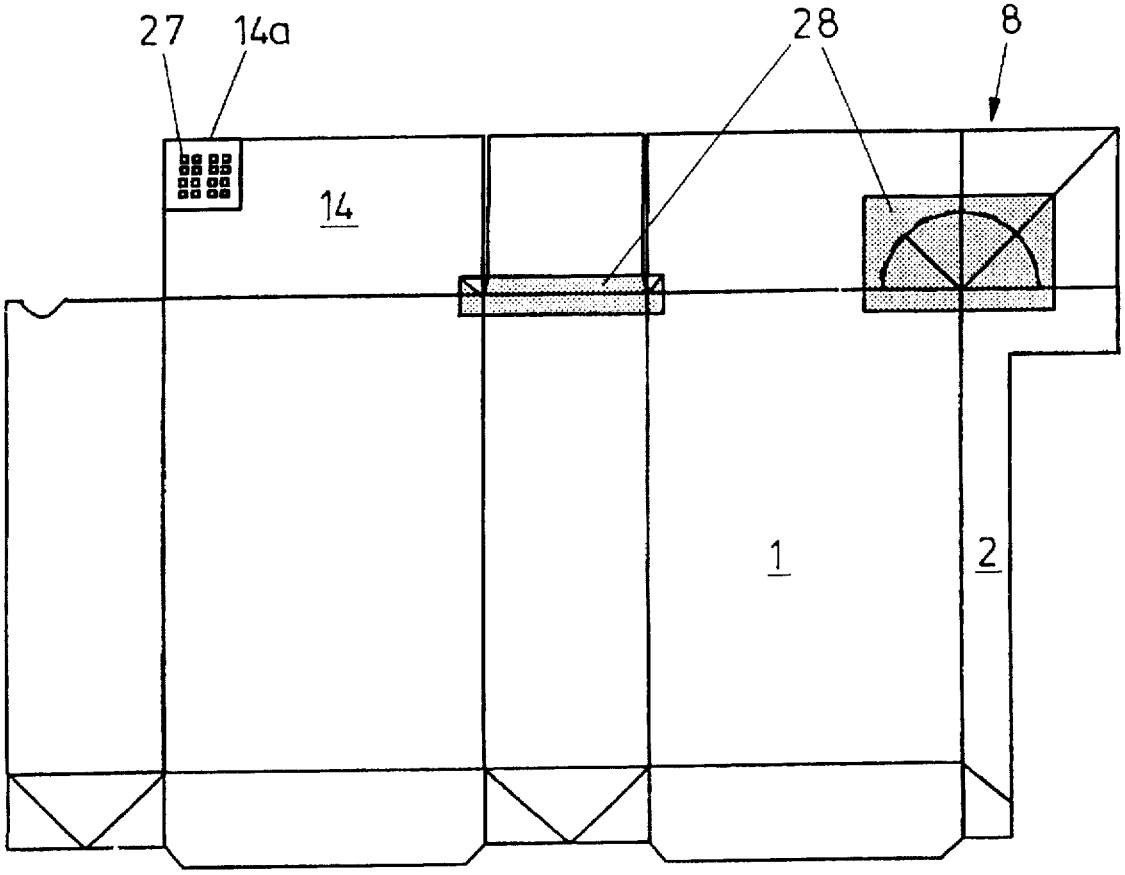
FIG. 9 shows a detailed blank of an alternative embodiment having a perforation covering the dispensing opening.

In an alternative embodiment of the anti push-through panel 14, which is shown in FIG. 9, the anti push-through panel, at the location of the dispensing opening, is not provided with a recess which clears a part of the dispensing opening, but the anti push-through panel 14 at that point comprises a part with a perforation 27, covering the dispensing opening. With such a perforation 27, powdery products can be suitably dispensed through the dispensing opening.

Figure 5:
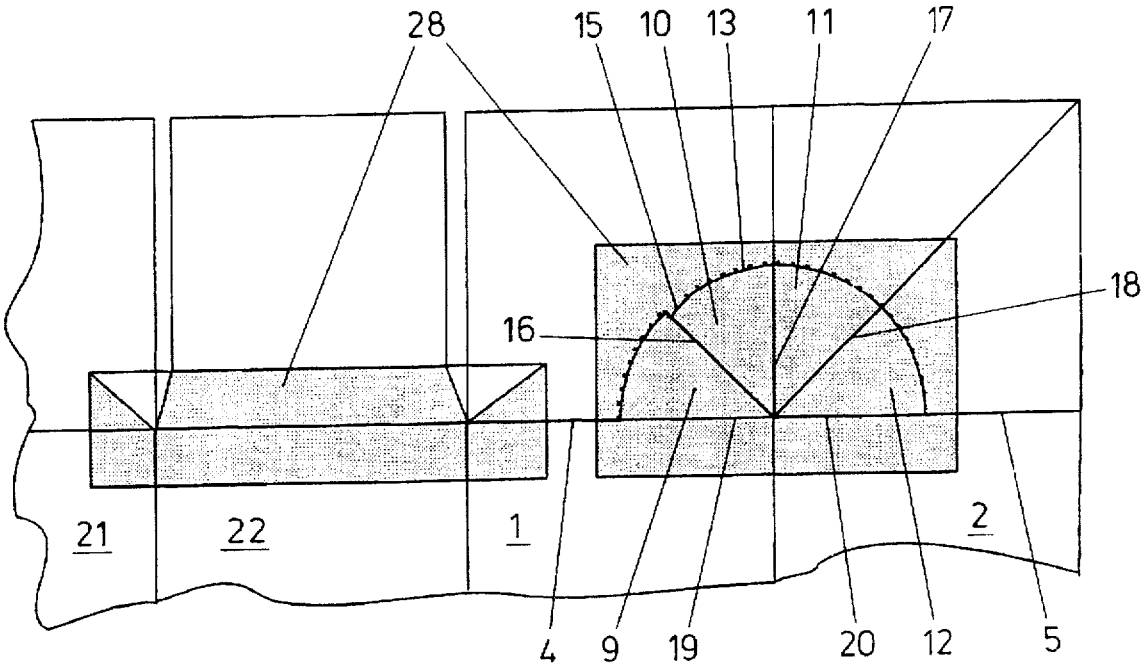
FIG. 5 shows a detailed blank view of the dispensing opening provision, with the dispensing opening provision comprising a lock edge.
Figure 6:
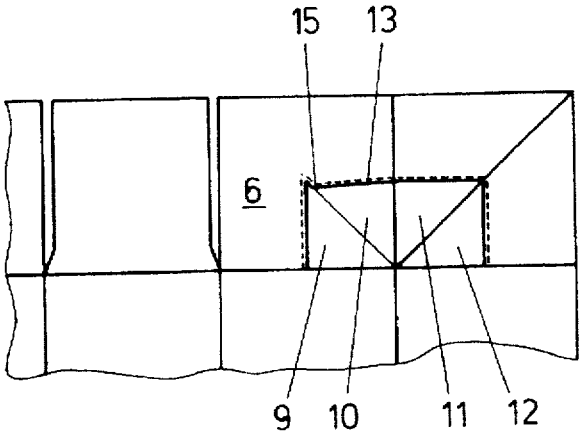
FIG. 6 shows a detailed blank view of an alternative embodiment of the dispensing opening provision, which dispensing opening provision likewise comprises a look edge.

In order to fully preclude the possibility of the dispensing opening provision 8 springing open in uncontrolled manner, the dispensing opening provision may comprise a lock edge which is shown in FIGS. 5 and 6. To that end, the distance from the perforation, tear and/or cutting line 13 of the second segment 10 to the corner point 7 is slightly smaller than the distance from the corner point 7 to the boundary edges 13, remote from the corner point 7, of the other segments 9, 11, 12. Thus the dispensing opening in the top wall 6, from which the second segment 10 originates, is bounded by a dispensing opening edge, designated lock edge 15, which is situated at a slightly smaller distance from the corner point 7 than the distance between the corner point 7 and the edge of the fourth segment 12, remote from the corner point 7, so that in the reclosed condition the fourth segment 12 can be clicked under the lock edge 15 and is fixed there between an anti push-through portion 14*a* and the lock edge 15.

If in the reclosed condition the second and third segments 10, 11 are located in the box interior, the dispensing opening provision 8 can be opened by pressing on the top wall 6 adjacent the dispensing opening provision 8. As a result of the pressure exerted on the top wall 6, the fourth segment 12 clicks from under the lock edge 15 and the dispensing opening provision 8 remains in a partly opened position due to the friction with the anti push-through portions 14*a*, so that the dispensing opening provision 8 can be readily gripped by the user to be opened further. Optionally, the printing on the box may indicate where the user is to press to obtain the above-described effect. When during the reclosure of the dispensing opening provision 8 the second and the third segment 10, 11 are not pushed into the box interior but in the reclosed condition are situated on the side of the top wall 6 remote from the box interior, these segments 10, 11 in surface-to-surface abutment can be used as a hand grip for opening the dispensing opening provision 8.

In the exemplary embodiments shown in FIGS. 1–5 and 7–8, the first through the fourth segments 9–12 are designed as sectors of a circle, of which the straight sector edges 16, 17, 18 adjoin each other. The straight sector edges of each sector of a circle 9–12 include an angle of substantially 45°. A straight sector edge 19 of the first segment 9 coincides with the first upper edge 4, while a straight sector edge 20 of the fourth segment 12 coincides with the upper edge 5. A common straight sector edge 17 of the second and third segments 10, 11 is situated in alignment with the side corner edge 3 in the open contrition of the dispensing opening provision 8. The centers of the circular arc-shaped edges 13 of the segments 9–12 coincide with the corner point 7. In order to provide a lock edge 15, the radius of the second segment 10, at least throughout a part of the circular arc-shaped snaped edge 13 thereof, is a fraction smaller than the radius of the circular arc-shaped edges 13 of the other segments 9, 11, 12.

As already described hereinabove, in the reclosed position of the dispensing opening provision 8, the second and the third segment 10, 11 may be situated in the box interior but they may also be situated on the side of the top wall 6 remote from the box interior, so that they can be readily gripped by the user. The last position can for instance be used when the box needs to be closed only very temporarily.

Figure 7:
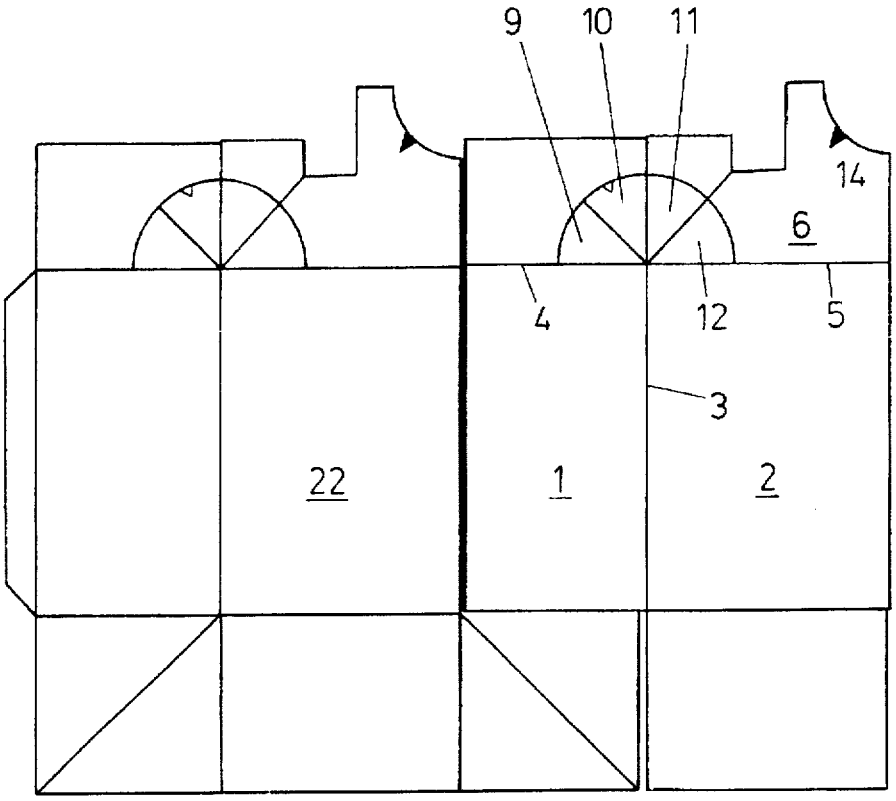
FIG. 7 shows a blank of a boxlike package with two dispensing opening provisions, as shown in FIG. 8.

The side panels 1, 2 can form a sidewall but it is also possible for the second side panel 2 to be an adhesive strip which has been adhered to a side of a sidewall 21 proximal to the box interior. The sidewall 21 in question can have a recess 22, to be designated as nail hole, adjacent the corner point 7. The nail hole 22 makes it easier for the user to grip the second and the third segment 10, 11 when the dispensing opening provision 8 is still in the unopened condition. The blank of a so-designed package is shown in FIG. 1. A blank in which the first and the second side panel 1, 2 also constitute a sidewall is shown in FIG. 7. Both FIG 1 and FIG. 7 clearly show that the anti push-through panel 14 is connected with another side panel 22. In order to obtain a stable joint between the anti push-through panel 14 and the top wall 6, the anti push-through panel 14 may be adhered against the side of the top wall 6 proximal to the box interior.

In order to obtain a dust-tight or air-tight closure of the dispensing opening provision 8, the anti push-through portions 14*a* of the anti push-through panel 14 may be provided with re-adhesive glue.

In order to provide for further dust-tightness and air-tightness of the box, adhesive strips 28 can be provided on the parts of the dispensing opening provision 8 proximal to the box interior and optionally at some corner points, before the blank is folded into a box. Examples of such adhesive stripe 28 are shown in FIG. 5 where the grey portions contain glue and the white portions contain no glue. The adhesive strips 28 are preferably manufactured from air-tight and moisture-proof, grease-proof paper. A likewise dust-tight and air-tight bottom is obtained by the blank as shown in FIG. 1, where each sidewall 1, 2, 21, 22 and/or 23 is connected at a lower edge 24 thereof with a bottom panel 25, which bottom panels 25 are mutually connected through fold lines and further comprise fold lines 26 extending at an angle of 45° to the lower edge 24, which fold lines 26 make it possible to fold up the bottom panel 25, so that the bottom panels 25 extend at an angle of substantially 90° to the sidewalls. Because the bottom panels 25 are mutually connected, there will be no leakage at the corner points of the bottom wall In order to make the perforation, tear and/or cutting line by means of which the segments 9, 10 are connected to the top wall 6 dust-tight as well, use can be made of a technique which in practice is designated by the term "offset staggered scoring", whereby the blank material is incised over half its thickness from both the top and the bottom, with the incisions on the upper side being slightly staggered relative to the incisions on the underside of the blank. By this technique, the blank material is not fully pierced anywhere, so that it is also dust-tight at the location of the offset staggered score line.

Accordingly, with the above-described measures, a box-like package is obtained which is dust-tight and air-tight both in the unopened and in the reclosed condition. Such a package is therefore suitable for perishable goods, such as for instance cereals or similar moisture-absorbing products.

Figure 8:
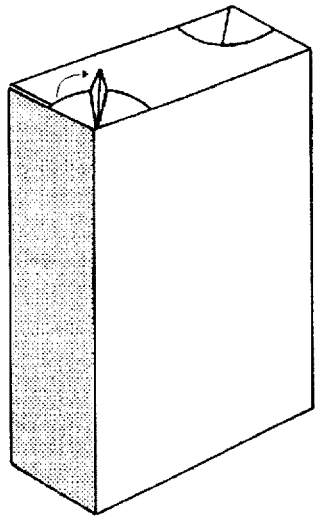
FIG. 8 shows a boxlike package of which the blank is shown in FIG. 7.

It is clear that the invention is not limited to the exemplary embodiment described. For instance, the boxlike package may comprise two dispensing opening provisions, each of the type as described with reference to FIGS. 1–6. A package comprising two dispensing opening provisions is shown in FIG. 8 and the blank thereof in FIG. 7. Optionally, the box interior of the package may be divided up into two compartments by arranging a partition in the box interior. One dispensing opening provision connects to one compartment and the other dispensing opening provision to the other. Thus, in one boxlike package two products can be stored separately.

What is claimed is:

1. A package which is produced from a single blank through folding and adhesion, in which a first side panel and second side panel adjoin each other through a side corner edge, the first and second side panels each adjoining a top wall by a first and a second upper edge, respectively, said first and second upper edges and the side corner edge intersecting in a corner point, the package having an interior, wherein a reclosable dispensing opening provision is provided at the corner point, the dispensing opening provision having an unopened conditioned, an opened condition, and a reclosed condition, the dispensing opening provision comprising two spout surfaces which comprise a first and a second, and a third and a fourth segment, wherein, in the unopened condition of the dispensing opening provision, the first and the second segment form part of the top wall and are connected therewith via separation lines, while the third and the fourth segment are situated proximal to the interior; wherein, for forming a dispensing opening in the top wall and thereby placing the dispensing opening provision in the opened condition, the separation lines are breakable, so that the first and the second segment can be swung clear of the top wall and situated in a plane which also contains the first side panel, while the third and the fourth segment are situated in a plane which contains the second side panel; wherein, in the reclosed condition of the dispensing opening provision, the first and the fourth segment are situated in a plane which also contains said top wall, while the second and the third segment are in abutment, the top wall comprising an anti push-through panel proximal to the interior, the anti push-through panel partly reducing the dispensing opening through anti push-through portions, so that the first and the fourth segment cannot be pushed into the interior during reclosure of the dispensing opening, the top wall comprising a lock edge which, in the unopened condition, is opposite the separation line from the second segment, wherein the distance from the lock edge to the corner point is slightly smaller than the distance from the corner point to a boundary edge of the fourth segment remote from the corner point, so that, in the reclosed condition, the boundary edge of the fourth segment is clicked under the lock edge and therefixed between a portion of the anti push-through panel and the lock edge.

2. A package according to claim 1, wherein the anti push-through portions are so designed that the second and the third segment, when situated in the interior in the reclosed condition of the dispensing opening provision, are in frictional engagement therewith.

3. A package according to claim 1, wherein the first through the fourth segment are designed as sectors of a circle, each sector having two straight sector edges through the corner point and an arc-shaped edge remote from the corner point, each sector including an angle of substantially 45°, a straight sector edge of the first and fourth segment, respectively, coinciding with the first and second upper edge, respectively, and, in the opened condition of the dispensing opening provision, a straight sector edge common to the second and third segments being situated in alignment with the side corner edge.

4. A package according to claim 3, wherein the lock edge is formed in that the radius of the second segment, at least throughout a part of the arc-shaped edge thereof, is a fraction smaller than radii of the arc-shaped edges of the other segments.

5. A package according to claim 1, wherein in the reclosed position the second and the third segment are situated in the interior.

6. A package according to claim 1, wherein in the reclosed position the second and the third segment are situated on the side of the top wall remote from the interior.

7. A package according to claim 1, wherein the second side panel comprises an adhesive strip which is adhered against a side of a sidewall proximal to the interior, the sidewall having a nail hole recess which facilitates gripping of the second and third segments in the unopened condition.

8. A package according to claim 1, wherein the anti push-through panel is connected with a further side panel of the package and is adhered to the top wall proximal to the interior.

9. A package according to claim 1, wherein the first and the second side panel are sidewalls.

10. A package according to claim 1, wherein the anti push-through portions of the anti push-through panel are provided with re-adhesive glue to provide a dust-proof sealing of the box in the reclosed condition.

11. A package according to claim 1, wherein the anti push-through portions cover the entire dispensing opening, the anti push-through portions being provided with a perforation which is arranged for allowing powdered products to pass.

12. A package according to claim 1, wherein on the dispensing opening provision proximal to the interior, an adhesive strip is provided before the blank is folded into a box, so that the dispensing opening provision are airtight in the unopened condition.

13. A package according to claim 9, wherein each sidewall is connected at a lower edge to a bottom panel, the bottom panels being mutually interconnected and being provided with fold lines which make it possible to fold the bottom panels up, so that the bottom panels include an angle of substantially 90° with the sidewalls.

14. A package according to claim 1, further having a second dispensing opening provision connected to a separate compartment in the package.

15. A package which is produced from a single blank through folding and adhesion, in which a first side panel and second side panel adjoin each other through a side corner edge, the first and second side panels each adjoining a top wall by a first and a second upper edge, respectively, said first and second upper edges and the side corner edge intersecting in a corner point, the package having an interior, wherein a reclosable dispensing opening provision is provided at the corner point, the dispensing opening provision having an unopened conditioned, an opened condition, and a reclosed condition, the dispensing opening provision comprising two spout surfaces which comprise a first and a second, and a third and a fourth segment, wherein, in the unopened condition of the dispensing opening provision, the first and the second segment form part of the top wall and are connected therewith via separation lines, while the third and the fourth segment are situated proximal to the interior; wherein, for forming a dispensing opening in the top wall and thereby placing the dispensing opening provision in the opened condition, the separation lines are breakable, so that the first and the second segment can be swung clear of the top wall and situated in a plane which also contains the first side panel, while the third and the fourth segment are situated in a plane which contains the second side panel; wherein, in the reclosed condition of the dispensing opening provision, the first and the fourth segment are situated in a plane which also contains said top wall, while the second and the third segment are in abutment, the top wall comprising an anti push-through panel proximal to the interior, the anti push-through panel partly reducing the dispensing opening through anti push-through portions, so that the first and the fourth segment cannot be pushed into the interior during reclosure of the dispensing opening, wherein the first through the fourth segment are designed as sectors of a circle, each sector having two straight sector edges through the corner point and an arc-shaped edge remote from the corner point, each sector including an angle of substantially 45°, a straight sector edge of the first and fourth segment, respectively, coinciding with the first and second upper edge, respectively, and, in the opened condition of the dispensing opening provision, a straight sector edge common to the second and third segments being situated in alignment with the side corner edge, wherein a lock edge is formed in that the radius of the second segment, at least throughout a part of the arc-shaped edge thereof, is a fraction smaller than radii of the arc-shaped edges of the other segments.

16. A package which is produced from a single blank through folding and adhesion, in which a first side panel and second side panel adjoin each other through a side corner edge, the first and second side panels each adjoining a top wall by a first and a second upper edge, respectively, said first and second upper edges and the side corner edge intersecting in a corner point, the package having an interior, wherein a reclosable dispensing opening provision is provided at the corner point, the dispensing opening provision having an unopened conditioned, an opened condition, and a reclosed condition, the dispensing opening provision comprising two spout surfaces which comprise a first and a second, and a third and a fourth segment, wherein, in the unopened condition of the dispensing opening provision, the first and the second segment form part of the top wall and are connected therewith via separation lines, while the third and the fourth segment are situated proximal to the interior; wherein, for forming a dispensing opening in the top wall and thereby placing the dispensing opening provision in the opened condition, the separation lines are breakable, so that the first and the second segment can be swung clear of the top wall and situated in a plane which also contains the first side panel, while the third and the fourth segment are situated in a plane which contains the second side panel; wherein, in the reclosed condition of the dispensing opening provision, the first and the fourth segment are situated in a plane which also contains said top wall, while the second and the third segment are in abutment, the top wall comprising an anti push-through panel proximal to the interior, the anti push-through panel partly reducing the dispensing opening through anti push-through portions, so that the first and the fourth segment cannot be pushed into the interior during reclosure of the dispensing opening, wherein the second side panel comprises an adhesive strip which is adhered against a side of a sidewall proximal to the interior, the sidewall having a nail hole recess which facilitates gripping of the second and third segments in the unopened condition.

17. A package which is produced from a single blank through folding and adhesion, in which a first side panel and second side panel adjoin each other through a side corner edge, the first and second side panels each adjoining a top wall by a first and a second upper edge, respectively, said first and second upper edges and the side corner edge intersecting in a corner point, the package having an interior, wherein a reclosable dispensing opening provision is provided at the corner point, the dispensing opening provision having an unopened conditioned, an opened condition, and a reclosed condition, the dispensing opening provision comprising two spout surfaces which comprise a first and a second, and a third and a fourth segment, wherein, in the unopened condition of the dispensing opening provision, the first and the second segment form part of the top wall and are connected therewith via separation lines, while the third and the fourth segment are situated proximal to the interior; wherein, for forming a dispensing opening in the top wall and thereby placing the dispensing opening provision in the opened condition, the separation lines are breakable, so that the first and the second segment can be swung clear of the top wall and situated in a plane which also contains the first side panel, while the third and the fourth segment are situated in a plane which contains the second side panel; wherein, in the reclosed condition of the dispensing opening provision, the first and the fourth segment are situated in a plane which also contains said top wall, while the second and the third segment are in abutment, the top wall comprising an anti push-through panel proximal to the interior, the anti push-through panel partly reducing the dispensing opening through anti push-through portions, so that the first and the fourth segment cannot be pushed into the interior during reclosure of the dispensing opening, wherein the anti push-through portions of the anti push-through panel are provided with re-adhesive glue to provide a dust-proof sealing of the box in the reclosed condition.

18. A package which is produced from a single blank through folding and adhesion, in which a first side panel and second side panel adjoin each other through a side corner edge, the first and second side panels each adjoining a top wall by a first and a second upper edge, respectively, said first and second upper edges and the side corner edge intersecting in a corner point, the package having an interior, wherein a reclosable dispensing opening provision is provided at the corner point, the dispensing opening provision having an unopened conditioned, an opened condition, and a reclosed condition, the dispensing opening provision comprising two spout surfaces which comprise a first and a second, and a third and a fourth segment, wherein, in the unopened condition of the dispensing opening provision, the first and the second segment form part of the top wall and are connected therewith via separation lines, while the third and the fourth segment are situated proximal to the interior; wherein, for forming a dispensing opening in the top wall and thereby placing the dispensing opening provision in the opened condition, the separation lines are breakable, so that the first and the second segment can be swung clear of the top wall and situated in a plane which also contains the first side panel, while the third and the fourth segment are situated in a plane which contains the second side panel; wherein, in the reclosed condition of the dispensing opening provision, the first and the fourth segment are situated in a plane which also contains said top wall, while the second and the third segment are in abutment, the top wall comprising an anti push-through panel proximal to the interior, the anti push-through panel partly reducing the dispensing opening through anti push-through portions, so that the first and the fourth segment cannot be pushed into the interior during reclosure of the dispensing opening, wherein on the dispensing opening provision proximal to the interior, an adhesive strip is provided before the blank is folded into a box, so that the dispensing opening provision is air-tight in the unopened condition.

19. A package according to claim 18, wherein an adhesive strip is provided on corner edges before the blank is folded into a box, so that the corner edges are airtight.

20. A package according to claim 18, wherein the adhesive strip is manufactured from air-tight, moisture-proof, grease-proof paper.

* * * * *

UNITED STATES PATENT AND TRADEMARK OFFICE

CERTIFICATE OF CORRECTION

PATENT NO. :5,711,479

DATED :JANUARY 27, 1998

INVENTOR(S) : JOHANNES FREDERICUS SPRONK

It is certified that error appears in the above-indentified patent and that said Letters Patent is hereby corrected as shown below:

In the Abstract, line 13, delete "look", insert --lock--

Col. 2, line 10, delete "trash-through", insert --push-through--

Col. 2, line 53, delete "look", insert --lock--

Col. 4, line 50, after "arch-shaped", delete "snaped"

Col. 5, line 18, delete "stripe", insert --strips--

Col. 5, line 32, delete "wall", insert --wall 25.--

Signed and Sealed this

Twenty-second Day of September, 1998

*Attest:*

Bruce Lehman

BRUCE LEHMAN

*Attesting Officer*

*Commissioner of Patents and Trademarks*